US005278555A

United States Patent [19]

Hoekman

[11] Patent Number: 5,278,555

[45] Date of Patent: Jan. 11, 1994

[54] SINGLE INDUCTIVE SENSOR VEHICLE DETECTION AND SPEED MEASUREMENT

[75] Inventor: Earl B. Hoekman, Roseville, Minn.

[73] Assignee: Minnesota Mining and Manufacturing Company, St. Paul, Minn.

[21] Appl. No.: 716,649

[22] Filed: Jun. 17, 1991

[51] Int. Cl.[5] ..... G08G 1/01

[52] U.S. Cl. ..... 340/941; 324/236; 340/933; 340/936; 364/438

[58] Field of Search ..... 340/933, 936, 934, 938, 340/941; 364/436, 437, 438; 324/178, 173, 207.16, 207.23, 175, 655, 179, 236

[56] References Cited

U.S. PATENT DOCUMENTS

| | | | |
|---|---|---|---|
| 3,609,679 | 9/1971 | Updegraff et al. | 340/941 |
| 4,234,923 | 11/1980 | Eshraghian et al. | 340/941 |
| 4,369,427 | 1/1983 | Drebinger et al. | 340/941 |
| 5,153,525 | 10/1992 | Hoekman et al. | 340/941 |

FOREIGN PATENT DOCUMENTS

| | | | |
|---|---|---|---|
| 0089030 | 9/1983 | European Pat. Off. | 340/941 |
| 0126958 | 12/1984 | European Pat. Off. . | |
| 0572831 | 9/1977 | U.S.S.R. | 340/941 |
| 0752448 | 7/1980 | U.S.S.R. | 340/936 |

*Primary Examiner*—Brent Swarthout
*Attorney, Agent, or Firm*—Gary L. Griswold; Walter N. Kirn; William B. Barte

[57] ABSTRACT

A determination is made whether a minimum threshold period (or frequency) change has occurred in an oscillator signal indicating the initial presence of a vehicle over an inductive sensor. The change in period of the oscillator signal is measured over each of a plurality of frame segments. A magnitude of period change in the oscillator signal is recorded. If the number of frame segments that occur between detection of the threshold change in period and the magnitude change in period is less than a predetermined number, the detector does not make a speed measurement calculation. If the number of frame segments equals or exceeds the predetermined number, the time rate of change of the period of the oscillator signal is estimated. A vehicle detector calculates a sensor entry distance for a particular vehicle. A vehicle entry time is calculated by dividing the magnitude of period change by the rate of period change. Speed is then calculated by dividing the entry distance by the vehicle entry time. The speed measurement is directed to an output by activating the output for a period of time proportional to the speed of the vehicle. Multiple vehicles may be detected by adjusting the minimum threshold period change, after each vehicle passes, by the peak change in oscillator signal period caused by that vehicle. Vehicle length may be calculated by multiplying the measured speed by the total time between vehicle entry and exit from the loop area, and subtracting the length of the detection area.

17 Claims, 3 Drawing Sheets

SINGLE INDUCTIVE SENSOR VEHICLE DETECTION AND SPEED MEASUREMENT

BACKGROUND OF THE INVENTION

The present invention relates to vehicle detectors which detect the passage or presence of a vehicle over a defined area of a roadway. In particular, the present invention relates to a method of vehicle speed measurement using a single inductive sensor of a vehicle detector.

Inductive sensors are used for a wide variety of detection systems. For example, inductive sensors are used in systems which detect the presence of conductive or ferromagnetic articles within a specified area. Vehicle detectors are a common type of detection system in which inductive sensors are used.

Vehicle detectors are used in traffic control systems to provide input data required by a controller to control signallights. Vehicle detectors are connected to one or more inductive sensors and operate on the principle of an inductance change caused by the movement of a vehicle in the vicinity of the inductive sensor. The inductive sensor can take a number of different forms, but commonly is a wire lop which is buried in the roadway and which acts as an inductor.

The vehicle detector generally includes circuitry which operates in conjunction with the inductive sensor to measure changes in inductance and to provide output signals as a function of those inductance changes. The vehicle detector includes an oscillator circuit which produces a oscillator output signal having a frequency which is dependent on sensor inductance. The sensor inductance is in turn dependent on whether the inductive sensor is loaded by the presence of a vehicle. The sensor is driven as a part of a resonant circuit of the oscillator. The vehicle detector measures changes in inductance in the sensor by monitoring the frequency of the oscillator output signal.

Examples of vehicle detectors are shown, for example, in U.S. Pat. No. 3,943,339 (Koerner et al.) and in U.S. Pat. No. 3,989,932 (Koerner).

A critical parameter in nearly all traffic control strategies is vehicle speed. In most circumstances, traffic control equipment must make assumptions about vehicle speed (e.g., that the vehicle is traveling at the speed limit) while making calculations. Currently there are no devices available that both detect vehicles and measure vehicle speed on a real-time basis. Usually, the device to which the vehicle detector provides its outputs calculates the speed of the detected vehicle. While counter/-classifier devices do contain vehicle detectors and are capable of measuring speed, they do not provide calculations to external devices in real time.

A commonly used method of measuring vehicle speed with a single loop inductive sensor is to have the detector make the assumption that all vehicles are the same length. The speed of the vehicle may then be estimated based on the time the vehicle is over the loop. This method uses the following formula:

$$S = \frac{AVL + (k^{*}L_{loop})}{DVD} \qquad \text{Equation 1}$$

where,

S=speed estimate

AVL=assumed vehicle length $L_{loop}$=loop length

DVD=duration of vehicle detection k=constant greater than one which depends on loop geometry Using this method, the speed estimate for any given vehicle will have an error directly related to the difference of the vehicle's actual length from the of error arising from the use of this method is due to miscalculations of the duration of vehicle detection (DVD). These miscalculations are a function of sensitivity setting, vehicle type, detector scan time, and of the scan time of the external device that is actually making the speed calculations. While this method can provide a relatively accurate measurement of the average vehicle speed, it is inadequate for measurement of individual vehicle speed.

It is desirable to achieve accuracy in the measurement of individual vehicle speed with an error of less than five percent. This degree of accuracy is difficult to achieve even with the two loop and two detector systems in common use. These two loop systems calculate speed using the following equation:

$$S = \frac{\text{loop spacing}}{t_{VD2} - t_{VD1}} \qquad \text{Equation 2}$$

where, loop spacing=length of space between inductive loop sensors $t_{VD2}$=time of vehicle detection at second loop $t_{VD1}$=time of vehicle detection at first loop This two loop method also contains several sources of possible error. First, the terms in the denominator, $t_{VD2}$ and $t_{VD1}$, are difficult to obtain accurately. In a scanning-type vehicle detector in which multiple inductive sensors (or "detector channels") are interrogated on a time-multiplexed basis, the actual time of vehicle entry is indeterminate by at least the length of time required to scan all of the detector channels. Similarly, the device receiving the vehicle detector's outputs will typically scan the outputs of multiple vehicle detectors. Further uncertainty results as the vehicle detector attempts to ascertain when the vehicle enters the second loop. Another source of error is vehicle bounce. Due to these sources of error, the best two loop speed measurement systems available today have a typical accuracy for any specific vehicle of plus or minus twenty percent when the vehicle being detected is travelling at freeway speeds.

SUMMARY OF THE INVENTION

The present invention is an improved method of vehicle sensing in which changes in inductance of an inductive sensor while a vehicle is within the detection area of the sensor are used to provide additional information beyond simple vehicle detection.

With the present invention, vehicle speed measurement using a single inductive sensor is achieved. The method utilizes a relationship between the time rate of change of inductance, the total change in inductance, and vehicle speed. The present invention allows the vehicle detector to perform the functions of vehicle detection and speed measurement, and to supply the speed of the vehicle as an additional output.

Using the method begins with the calculation of a sensor detection area entry distance for a particular vehicle. An entry time for the vehicle is next calculated by dividing a measured magnitude of inductance change by the time rate of inductance change. Finally, speed is equivalent to the entry distance divided by the calculated entry time for a particular vehicle.

Another aspect of the invention is a method of detecting multiple vehicles entering the detection area of a single inductive sensor within a short period of time. In a preferred embodiment, a detector measures the sensor inductance and determines whether a minimum threshold change has occurred indicating the presence of a first vehicle. From subsequent inductance measurements a magnitude of a change in inductance is determined. A new threshold value based on the magnitude of the change is produced. Using this new threshold value, the presence of a second vehicle in the detection area can be detected, even though the first vehicle has not yet exited the detection area. Similarly, the vehicle speed measurement method may be used to measure the speed of each vehicle.

A third aspect of the invention is a method of detecting the length of vehicles over the detection area of a single inductive sensor. In a preferred embodiment, after vehicle entry into the sensor detection area, the vehicle speed is measured. The sensor's inductance is monitored for a value indicative of vehicle exit from the detection area, and the time duration between vehicle entry and exit is calculated. The vehicle length is then determined based upon the vehicle speed, the time duration between vehicle entry and exit from the detection area, and the length of the sensor detection area.

DETAILED DESCRIPTION OF THE PREFERRED EMBODIMENTS

(1) Overall System Description

Figure 1:
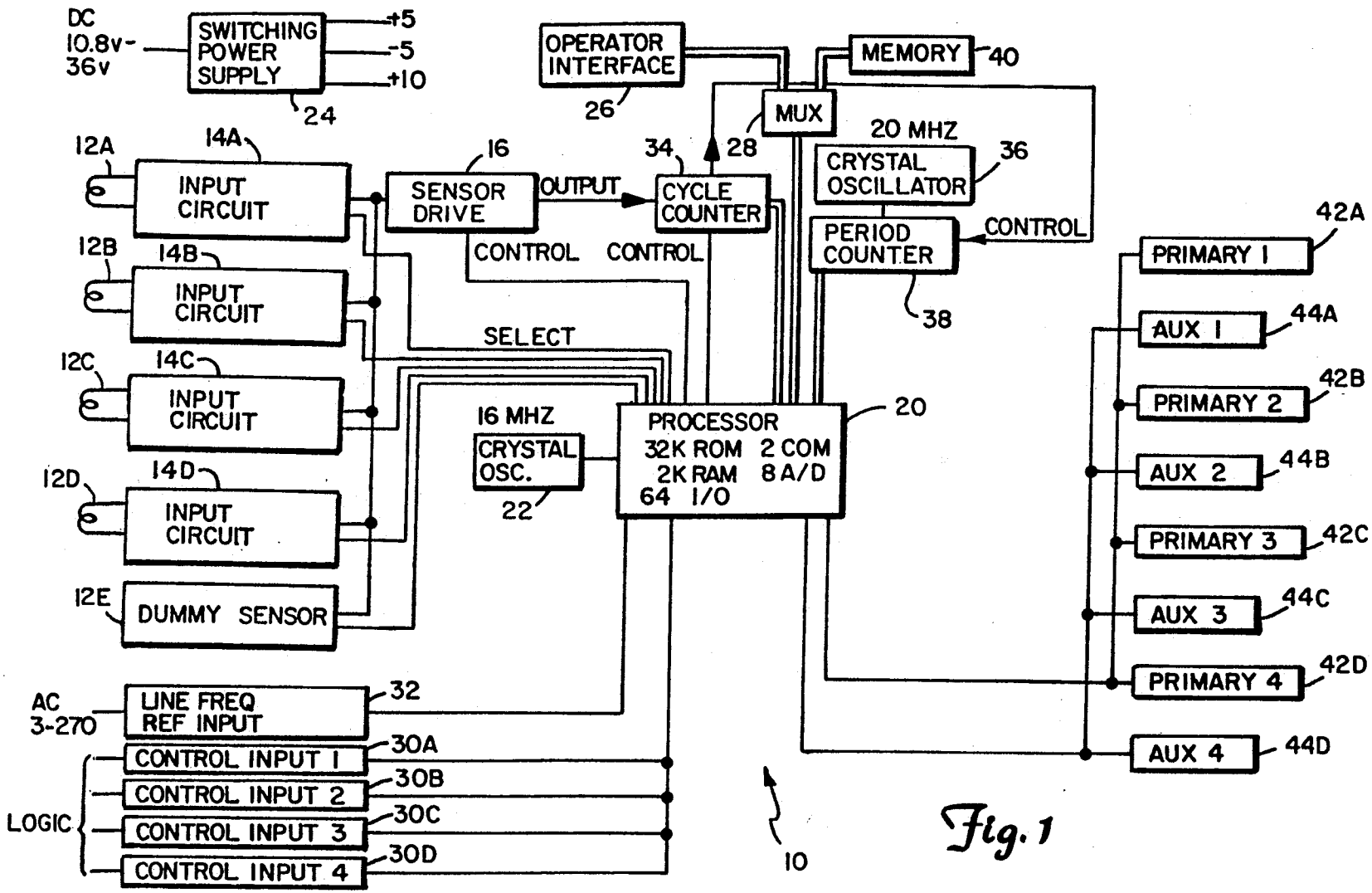
FIG. 1 is a block diagram of a vehicle detector which is capable of making use of the single inductive sensor vehicle speed measurement method.

Vehicle detector 10 shown in FIG. 1 is a four channel system which monitors the inductance of inductive sensors 12A, 12B, 12C and 12D. Each inductive sensor 12A–12D is connected to an input circuit 14A–14D, respectively. Sensor drive oscillator 16 is selectively connected through input circuits 14A–14D to one of the inductive sensors 12A–12D to provide a drive current to one of the inductive sensors 12A–12D. The particular inductive sensor 12A–12D which is connected to oscillator 16 is based upon which input circuit 14A–14D receives a sensor select signal from digital processor 20. Sensor drive oscillator 16 produces an oscillator signal having a frequency which is a function of the inductance of the inductive sensors 12A–12D to which it is connected.

Also shown in FIG. 1, dummy sensor 12E is provided and is connected to sensor drive oscillator 16 in response to a select signal from digital processor 20. Dummy sensor 12E has an inductance which is unaffected by vehicles, and therefore provides a basis for adjustment or correction of the values measured by inductive sensors 12A–12D.

The overall operation of vehicle detector 10 is controlled by digital processor 20. Crystal oscillator 22 provides a high frequency clock signal for operation of digital processor 20. Power supply 24 provides the necessary voltage levels for operation of the digital and analog circuitry within the vehicle detector 10.

Digital processor 20 receives inputs from operator interface 26 (through multiplexer 28), and receives control inputs from control input circuits 30A–30D. In a preferred embodiment, control input circuits 30A–30D receive logic signals, and convert those logic signals into input signals for processor 20.

Processor 20 also receives a line frequency reference input signal from line frequency reference input circuit 32. This input signal aids processor 20 in compensating signals from inductive sensors 12A–12D for inductance fluctuations caused by nearby power lines.

Cycle counter 34, crystal oscillator 36, period counter 38, and processor 20 form detector circuitry for detecting the frequency of the oscillator signal. Counters 34 and 38 may be discrete counters (as illustrated in FIG. 1) or may be fully or partially incorporated into processor 20.

A preferred embodiment of the present invention, a digital processor 20 includes on-board read only memory (ROM) and random access memory (RAM) storage. In addition, non-volatile memory 40 stores additional data such as operator selected settings which accessible to processor 20 through multiplexer 28.

Vehicle detector 10 has four output channels, one for each of the four sensors 12A–12D. The first output channel, which is associated with inductive sensor 12A, includes primary output circuit 42A and auxiliary output circuit 44A. Similarly, primary output circuit 42B and auxiliary output circuit 44B are associated with inductive sensor 12B and form the second output channel. The third output channel includes primary output circuit 42C and auxiliary output circuit 44C, which are associated with inductive sensor 12C. The fourth channel includes primary output circuit 42D and auxiliary output circuit 44D, which are associated with inductive sensor 12D.

Processor 20 controls the operation of primary output circuits 42A–42D, and also controls the operation of auxiliary output circuits 44A–44D. The primary output circuits 42A–42D provide an output which is conductive even when vehicle detector 10 has a power failure. The auxiliary output circuits 44A–44D, on the other hand, have outputs which are non-conductive when power to vehicle detector 10 is off.

In operation, processor 20 provides sensor select signals to input circuits 14A–14D to connect sensor drive oscillator 16 to inductive sensors 12A–12D in a time multiplexed fashion. Similarly, a sensor select signal to dummy sensor 12E causes it to be connected to sensor drive oscillator 16. Processor 20 also provides a control input to sensor drive oscillator 16 to select alternate capacitance values used to resonate with the inductive sensor 12A–12D or dummy sensor 12E. When processor 20 selects one of the input circuits 14A–14D or dummy sensor 12E, it also enables cycle counter 34. As sensor drive oscillator 16 is connected to an inductive load (e.g., input circuit 14A and sensor 12A) it begins to oscillate. The oscillator signal is supplied to cycle counter 34, which counts oscillator cycles. After a brief stabilization period for the oscillator signal to stabilize, processor 20 enables period counter 38, which counts in response to a very high frequency (e.g., 20 MHz) signal from crystal oscillator 36.

When loop counter 34 reaches a predetermined number ($N_{seg}$) of loop oscillator cycles after oscillator stabilization, it provides a control signal to period counter 38, which causes counter 38 to stop counting. The final count contained in period counter 38 is a function of the frequency of the oscillator signal, and therefore the inductance of inductive sensor 12A.

In a preferred embodiment of the present invention, each measurement period (which is defined by a predetermined number of sensor drive oscillator cycles) constitutes a "frame segment" of a larger "measurement frame". Each time a frame segment is completed, the final count from period counter 38 is combined with a number which is derived from the final counts produced during earlier frame segments to produce a measurement value. This measurement value is a function of the frequency of the oscillator output signal during the just-completed frame segment, as well as frequency measured during earlier frame segments.

The measurement value is then compared to a reference value. If the measurement value exceeds the reference value by greater than a threshold value, this indicates that a vehicle is present, and processor 20 provides the appropriate output signal to the appropriate primary and auxiliary output circuit.

(2) Speed Measurement

In the following discussion, changes in the oscillator signal caused by an inductance change of a sensor 12A–12D will be discussed in terms of period (T) rather than frequency (f). This is simply a matter of convenience for mathematical expression. Frequency is equal to the inverse of period (i.e., $f=1/T$). Frequency is inversely related to sensor inductance (L) while period is directly related to inductance.

Figure 2:
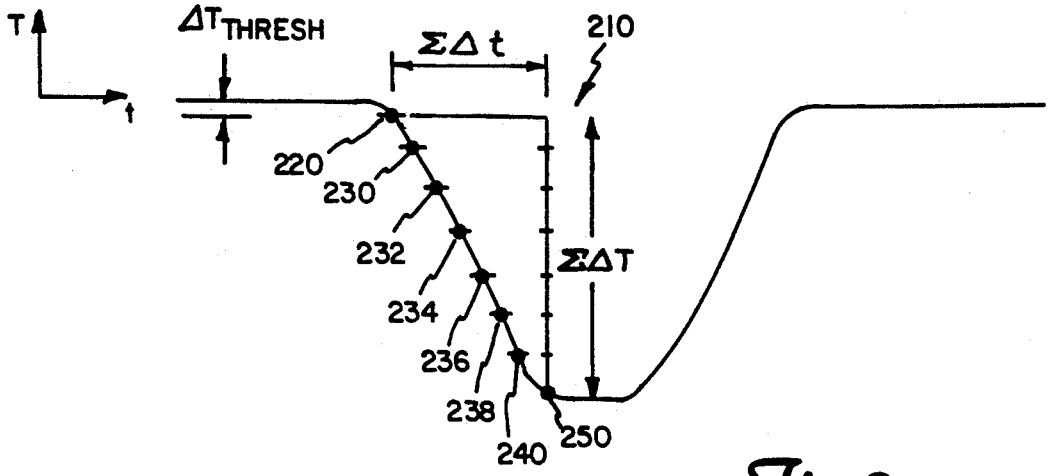
FIG. 2 is a graph illustrating measured period (T) of the oscillator signal as a function of time (t) as a vehicle passes through a detection area associated with the inductive sensor.

As illustrated in FIG. 2, processor 20 monitors the measurement value after each measurement frame segment for a change in value which exceeds the threshold value 220. Once the minimum threshold period change $\Delta T_{Thresh}$ 220 has occurred, indicating the initial presence of a Vehicle over the inductive sensor, processor 20 measures the change in period $\Delta T$ of the oscillator signal over each of a plurality of subsequent frame segments for the same inductive sensor. Individual measurement values are designated by points 220, 230, 232, 234, 236, 238, 240 and 250. Processor 20 detects and stores a magnitude of change in oscillator period $\Delta T_{MAX}$ 250 and the time at which it occurs. $\Delta T_{MAX}$ has been found to be a reasonable estimate of the inductance change that reflect both the time required for the vehicle to enter the sensor area and the presence of the vehicle in the sensor area.

If the number of frame segments that occur between detection of a threshold change in period $\Delta T_{Thresh}$ and the magnitude of change in period $\Delta T_{MAX}$ is equal to five or more, then processor 20 makes a speed measurement calculation. The number five has been chosen to ensure reasonable accuracy. A number larger than five would increase the detector accuracy. In this embodiment, if the number of frame segments is less than five, then no speed measurement calculations are performed.

Also, as illustrated in FIG. 2, processor 20 next estimates the time rate of period change dT/dt of the sensor drive oscillator signal period by summing the changes in period $\Delta T$ for each measurement frame segment between the detection of $\Delta T_{Thresh}$ and $\Delta T_{MAX}$, and dividing the summation by the total time elapsed during those measurement frame segments.

$$\frac{dT}{dt} = \frac{\Sigma \Delta T_i}{\Sigma \Delta t_i} \qquad \text{Equation 3}$$

Processor 20 then calculates the entry time ET for this particular vehicle, where ET is equal to the magnitude of change in period $\Delta T_{MAX}$ divided by dT/dt.

$$ET = \frac{\Delta T_{MAX}}{\frac{dT}{dt}} \qquad \text{Equation 4}$$

After determining the vehicle entry time ET, processor 20 calculates a specific entry distance $d_{entry}$ for the particular vehicle. Although the entry distance $d_{entry}$ may be characterized by many mathematical relationships, the following method is chosen for its ease of computation.

$$d_{entry} = d_{entryave} * A \left( B - \frac{\Delta T_{Thresh}}{\Delta T_{MAX}} \right) \qquad \text{Equation 5}$$

where, $d_{entryave}$ = user settable average entry distance with a default value of 11.7 feet

A = 2.0

B = 0.5

$\Delta T_{Thresh}$ = minimum threshold period change indicative of the initial presence of a vehicle $\Delta T_{MAX}$ = a magnitude of change in oscillator period caused by the vehicle Calculating a unique vehicle entry distance for each vehicle allows the detector to accurately measure the speed of vehicles with a length smaller than the length of the sensor detection area.

Processor 20 next calculates vehicle speed S which is equal to the vehicle entry distance dentry divided by the sensor entry time ET.

$$S = \frac{d_{entry}}{ET} \qquad \text{Equation 6}$$

After determining vehicle speed, processor 20 directs the speed measurement to an output (i.e., for purposes of this illustration, primary and auxiliary output circuits 42A and 44A) by activating the output for a period of time proportional to the speed of the vehicle. Processor 20 then turns the output off for a minimum of 50 milliseconds between vehicles.

Figure 4:
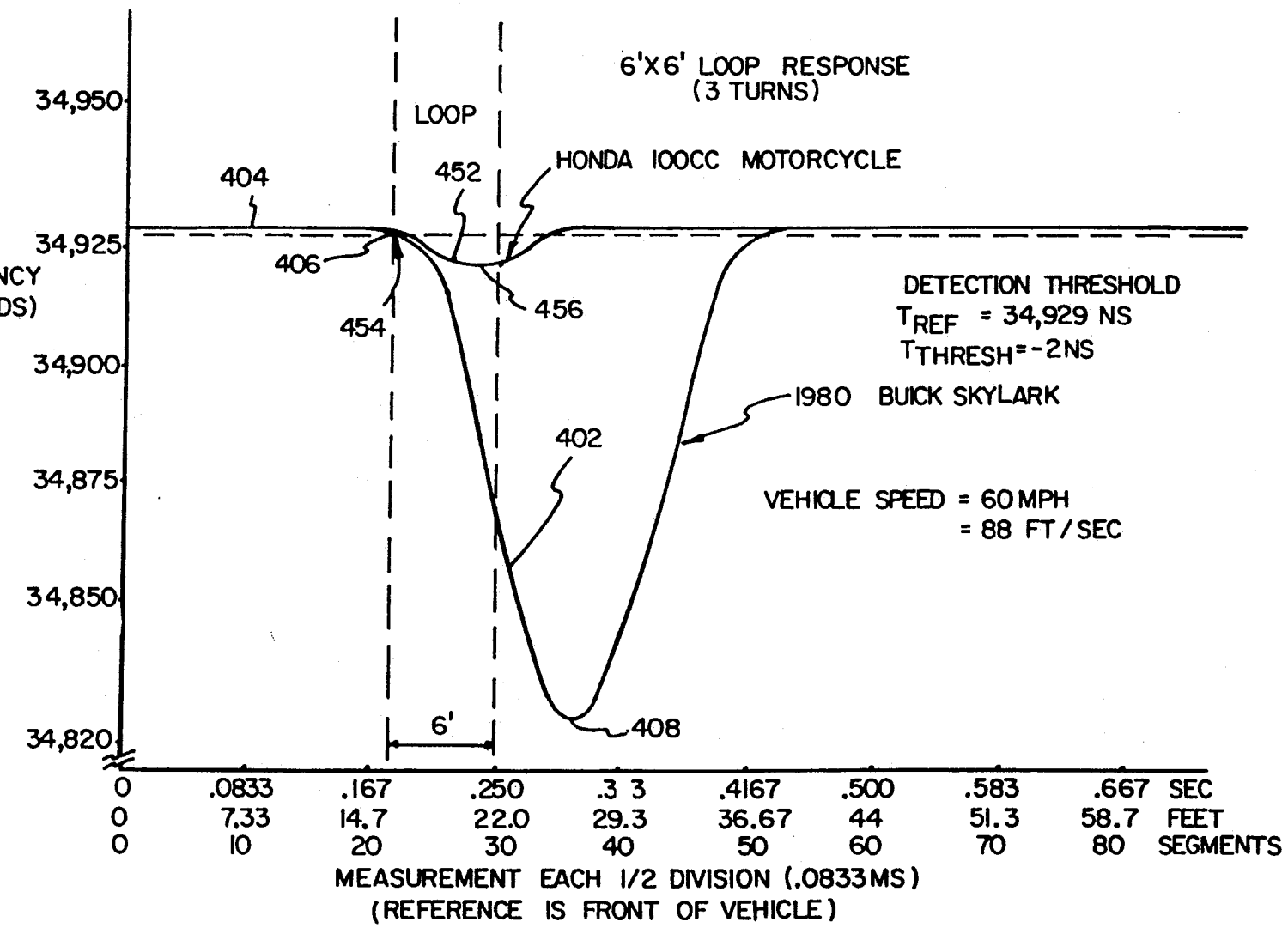
FIG. 4 is a graph illustrating actual measurements of period (T) as a function of time (t) as two separate vehicles passed through the detection area associated with an inductive sensor.

As mentioned above, the single inductive sensor speed measurement method provides increased accuracy not available with prior art systems. This accuracy is illustrated in two examples based upon actual measurements shown in FIG. 4. FIG. 4 illustrates the change in sensor drive oscillator signal period caused first by a 1980 Buick Skylark (curve 402), and second by a Honda 100cc motorcycle (curve 452), as each vehicle passes over the sensor detection area at a speed of 88 feet/sec (or 60 mph).

In the first example, as the car enters the detection area the threshold change in oscillator signal period is surpassed as shown by point 406 of FIG. 4. After a number of measurement frame segments, a magnitude change in period $\Delta T_{MAXCAR}$ is detected as shown by point 408. The actual value $\Delta T_{MAXCAR}$ is calculated by subtracting the initial reference period value 404 from the magnitude period value 408 as shown in Equation 7.

$$\Delta T_{MAXCAR} = 34{,}825 \text{ nanoseconds} - 34{,}929 \text{ nanoseconds} = -104 \text{ nanoseconds} \quad \text{Equation 7}$$

Next, the time rate of change dT/dt of the oscillator signal period is calculated. For ease of illustration, rather than summing the changes in period and time as shown in Equation 3, these values will be obtained as illustrated in Equations 8 and 9.

$$dT = \Delta T_{MAXCAR} - \Delta T_{Thresh} = -104 \text{ nanoseconds} - (-2 \text{ nanoseconds}) = -102 \text{ nanoseconds} \quad \text{Equation 8}$$

$$dt = (\#\text{ of measurment segments})^* \left(\frac{\text{time}}{\text{Measurement segment}}\right) = (15 \text{ segments})^* \left(\frac{.00833 \text{ seconds}}{\text{segment}}\right) = .125 \text{ seconds} \quad \text{Equation 9}$$

$$\frac{dT}{dt} = \frac{-102 \text{ nanoseconds}}{0.125 \text{ seconds}} = -816^*10^{-9} \quad \text{Equation 10}$$

The vehicle entry time $ET_{CAR}$ is then calculated as specified in Equation 4.

$$ET_{CAR} = \frac{\Delta T_{MAXCAR}}{\frac{dT}{dt}} = \frac{-104^*10^{-9}}{-816^*10^{-9}} = 0.12745 \text{ seconds} \quad \text{Equation 11}$$

An entry distance $d_{entrycar}$ is then calculated as specified in Equation 5.

$$d_{entrycar} = d_{entryave}{}^*A\left(B - \frac{\Delta T_{Thresh}}{\Delta T_{MAXCAR}}\right) = (11.7 \text{ ft.})^*(2.0)\left(0.5 - \frac{-2 \text{ nanosec}}{-104 \text{ nanosec}}\right) = 11.25 \text{ ft.} \quad \text{Equation 12}$$

Finally, speed is calculated as specified in Equation 6.

$$S_{CAR} = \frac{d_{entryCAR}}{ET_{CAR}} = \frac{11.25 \text{ ft.}}{0.12745 \text{ sec.}} = 88.26 \frac{\text{ft}}{\text{sec}} \quad \text{Equation 13}$$

The measured speed of 88.26 feet per second represents an error of less than 1% from the actual value of 88 feet per second.

In the second example, as the motorcycle enters the detection area the threshold change in oscillator signal period is surpassed as shown by point of FIG. 4. As in the previous example, a magnitude change in period $\Delta T_{MAXMOT}$ 456 is detected after a number of measurement frame segments. The actual value of $\Delta T_{MAXMOT}$ is similarly calculated by subtracting the initial reference period value 404 from the magnitude period value 456.

$$\Delta T_{MAXMOT} = 34{,}921 \text{ nanoseconds} - 34{,}929 \text{ nanoseconds} = -8 \text{ nanoseconds} \quad \text{Equation 14}$$

It is useful to note that the change in oscillator period 452 caused by the motorcycle is of lesser magnitude and duration than the change in oscillator period caused by the larger car.

Next the time rate of change dT/dt of the oscillator signal is calculated.

$$dT = \Delta T_{MAXMOT} - \Delta T_{Thresh} = -8 \text{ nanoseconds} - (-2 \text{ nanoseconds}) = -6 \text{ nanoseconds} \quad \text{Equation 15}$$

$$dt = (\#\text{ of measurment segments})^* \left(\frac{\text{time}}{\text{Measurement segment}}\right) = (6 \text{ segments})^* \left(\frac{.00833 \text{ seconds}}{\text{segment}}\right) = 0.050 \text{ seconds} \quad \text{Equation 16}$$

$$\frac{dT}{dt} = \frac{-6 \text{ nanoseconds}}{0.050 \text{ seconds}} = -120^*10^{-9} \quad \text{Equation 17}$$

The vehicle entry time $ET_{MOT}$ is then calculated.

$$ET_{MOT} = \frac{\Delta T_{MAXMOT}}{\frac{dT}{dt}} = \frac{-8^*10^{-9} \text{ seconds}}{-120^*10^{-9}} = 0.0667 \text{ seconds} \quad \text{Equation 18}$$

An entry distance $d_{entryMOT}$ is then calculated for the motorcycle.

$$d_{entryMOT} = d_{entryave}{}^*A\left(B - \frac{\Delta T_{Thresh}}{\Delta T_{MAXMOT}}\right) = (11.7 \text{ ft.})^*(2.0)\left(0.5 - \frac{-2 \text{ nanoseconds}}{-8 \text{ nanoseconds}}\right) = 5.85 \text{ ft.} \quad \text{Equation 19}$$

Finally, speed is calculated.

$$S_{MOT} = \frac{d_{entryMOT}}{ET_{MOT}} = \frac{5.85 \text{ ft.}}{0.0667 \text{ seconds}} = 87.71 \frac{\text{ft}}{\text{second}}$$ Equation 20

As in the first example, the measured motorcycle speed of 87.71 feet per second represents an error of less than 1% from the actual speed of 88 feet per second. The possibility does exist that occasionally an extra measurement segment will be used in the speed calculations, and therefore that the error could be higher. These situations would occur, for example, if the magnitude period change (point 456 in the motorcycle speed measurement example) occurred at the very beginning of a measurement frame segment. In this case, the time after detection of the magnitude period change but before the end of the measurement segment, will act to increase the error in speed measurement calculations.

As an example of this increased error possibility, assume that the magnitude period change $\Delta T_{MAXMOT}$ of the second example did not occur until the beginning of the seventh measurement segment. The increased measurement time would act to increase dt of equation 16 to a new value dt.

$$dt' = (7 \text{ segments})^* \left( \frac{0.00833 \text{ seconds}}{\text{segment}} \right) = 0.0583 \text{ seconds}$$ Equation 21

This increase will in turn have an effect on the time rate of period change dT/dt, the entry time $ET_{MOT}$, and the speed S calculations.

$$\frac{dT}{dt'} = \frac{-6 \text{ nanoseconds}}{0.0583 \text{ seconds}} = -103^*10^{-9}$$ Equation 22

$$ET_{MOT} = \frac{\Delta T_{MAXMOT}}{\frac{dT}{dt}} = \frac{-8 \times 10^{-9} \text{ seconds}}{-103 \times 10^{-9}} = 0.0776 \text{ seconds}$$ Equation 23

$$S_{MOT} = \frac{d_{entryMOT}}{ET_{MOT}} = \frac{5.85 \text{ ft}}{0.0776 \text{ seconds}} = 75.39 \frac{\text{ft}}{\text{sec}}$$ Equation 24

This possible measured motorcycle speed of 75.39 feet per second represents an error of less than 14.4% from the actual speed of 88 feet per second. This is, however, a worst case scenario and still represents an increase in accuracy from the two loop system available today.

(3) Multiple Vehicle Detection

Figure 3:
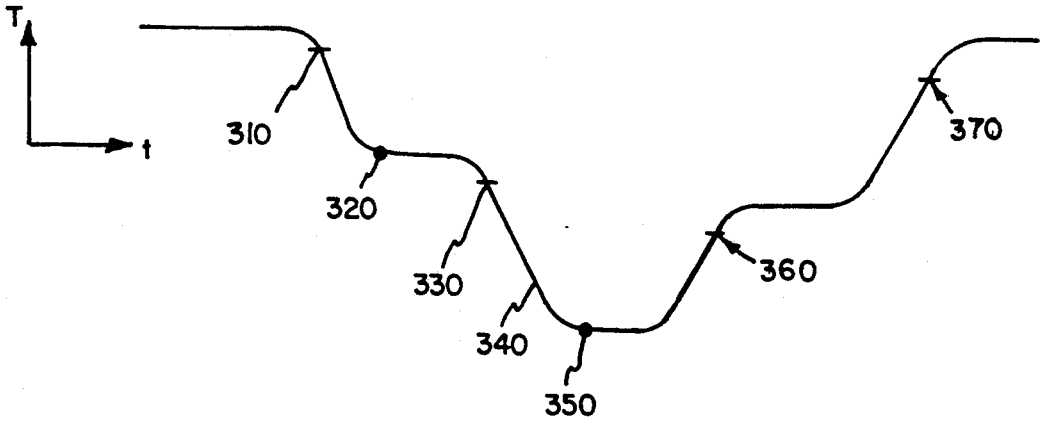
FIG. 3 is a diagram illustrating the necessary adjustment of the threshold change in oscillator period necessary to detect multiple vehicles.

A related aspect of the invention is a method of detecting the presence of multiple vehicles passing over the single inductive sensor within a short period of time. This method may be utilized in the measurement of vehicle speed while the presence of previous vehicles is still affecting the oscillator signal. The change in period ($\Delta T$) of the oscillator signal with only one vehicle present is calculated as follows:

$$\Delta T = T_{sensor} - T_{ref}$$ Equation 25 where $T_{sensor}$ = the measured period of the sensor drive oscillator signal with a single vehicle within the sensor detection area $T_{ref}$ = a reference period representative of the period of the sensor drive oscillator signal with no vehicle present within the sensor area If $\Delta T$ is greater than a threshold value $\Delta t_{Thresh}$, then a vehicle has been detected. If multiple vehicles pass over the inductive sensor within a short period of time as illustrated in FIG. 3, $\Delta T_{Thresh}$ must be adjusted after the entry and exit of each vehicle before another vehicle may be detected.

There are several methods of adjusting $\Delta T_{Thresh}$ in order to detect additional Vehicles. FIG. 3 is illustrative of a preferred method. In this method, after the vehicle detector 10 detects a change in period $\Delta T$ of the oscillator signal which exceeds $\Delta T_{Thresh}$ 310, the detector monitors the inductive sensor for a first peak change in period $\Delta T_{P1}$ 320. The new threshold $\Delta T_{Threshl}$ 330 is defined by:

$$\Delta T_{Thresh1} = \Delta T Thresh + \Delta TP1$$ Equation 26

As additional vehicles enter the sensor area the threshold may be defined by:

$$\Delta T_{Threshn} = \Delta T_{Thresh} + \sum_{i=1}^{n} \Delta T_{pi}$$ Equation 27 where $\Delta T_{Threshn}$ = the threshold value for detection of another vehicle with n vehicles presently over the inductive sensor $\Delta T_{Thresh}$ = the original threshold value with no vehicles over the inductive sensor $\Delta T_{pi}$ = the peak change in period caused by the $i_{th}$ vehicle = $T_{pi} - T_{refi-1}$ The $n^{th}$ vehicle will then be detected when:

$$T_{sensor} - T_{ref} > \Delta T_{threshn}$$ Equation 28

The change in period 340 and the peak change in period 350 caused by a second vehicle are also shown in FIG. 3. This method of adjusting the threshold change in frequency may be repeated for multiple vehicles. As vehicles leave the inductive sensor detection area, the threshold is then adjusted by subtracting the peak change in period $\Delta T_{pi}$ caused by that vehicle. This is illustrated by points 360 after exit of the first vehicle and point 370 after exit of the second vehicle.

A second method of adjusting $\Delta T_{Thresh}$ utilizes the average change in period caused by the n cars currently over the inductive sensor. Under this method a reference value $T_{refn}$ is calculated by:

$$T_{refn} = T_{ref} + (n^* \Delta T_{ave})$$ Equation 29 where, $T_{refn}$ = the reference value with n vehicles over the inductive sensor $T_{ref}$ = the initial reference value with no vehicles over the inductive sensor n = the number of vehicles currently over the inductive sensor $\Delta T_{ave}$ = the average oscillator signal period change per vehicle The new threshold value $\Delta T_{Threshn}$ is then defined as:

$$\Delta T_{Threshn} = T_{refn} + \Delta T_{Thresh} \quad \text{Equation 30}$$

Another vehicle will be detected when:

$$T_{sensor} - T_{ref} > \Delta T_{Threshn} \quad \text{Equation 31}$$

or alternatively when:

$$T_{sensor} - T_{refn} > \Delta T_{Thresh} \quad \text{Equation 32}$$

A vehicle is considered to have exited the inductive sensor when:

$$|T - T_{refn}| < |\Delta \frac{T_{Thresh}}{4}| \quad \text{Equation 33}$$

After a vehicle exits, n is reduced by one and $T_{refn}$ and $\Delta T_{Threshn}$ are appropriately adjusted.

An important advantage of the multiple vehicle detection is that it permits the speed measurement to be made in a multiple vehicle situation. Once the threshold has been reset, the speed measurement method described above can be repeated for the new vehicle using the new threshold value.

(4) Vehicle Length Detection

Another related aspect of the invention is a method of detecting the length of one or more vehicles passing over the inductive sensor detection area. This method may also be used in the measurement of vehicle length while the presence of previous vehicles is still affecting the oscillator signal. After vehicle speed S has been calculated, the period of the sensor drive oscillator signal is monitored for a value indicative of vehicle exit from the sensor detection area. A time duration $t_{call}$, equivalent to the time between vehicle entry and vehicle exit from the detection area, is calculated.

$$t_{call} = t_{exit} - t_{entry} \quad \text{Equation 34}$$

where $t_{exit}$ = time of vehicle exit from the sensor detection area $t_{entry}$ = time of vehicle entry into the sensor detection area The vehicle length $L_{vehicle}$ is then defined by:

$$L_{vehicle} = (S^* t_{call}) - L_{sensor} \quad \text{Equation 35}$$

where $L_{vehicle}$ = the length of the vehicle being measured

S = the speed of the vehicle being measured $t_{call}$ = the time duration between vehicle entry and vehicle exit from the sensor detection area $L_{sensor}$ = the length of the sensor detection area As within other aspects of the invention, the vehicle length detection method may be used in a multiple vehicle situation. In this situation, the length of each of a plurality of vehicles within the detection area at the same time may be measured.

(5) Conclusion

The present invention uses three measured parameters—the time rate of change of inductance (or oscillator period), the total inductance (or period) change and the total time duration between vehicle entry and exit of the sensor detection area—to provide speed length detection capabilities not previously available in inductive sensor vehicle detectors.

Although the present invention has been described with reference to preferred embodiments, workers skilled in the art will recognize that changes may be made in form and detail without departing from the spirit and scope of the invention.

What is claimed is:

1. A vehicle monitoring method using an inductive sensor consisting of a single inductive element having an inductance which changes upon the presence of a said vehicle and which is driven by an oscillator to produce an oscillator signal having a period which is a function of inductance of said inductive element and having certain predetermined waveform parameters unique to various particular types of vehicles, the method comprising:

(a) setting an initial predetermined threshold beyond which a further change in said period is indicative of the presence of a said vehicle;

(b) detecting entry of a vehicle into a detection area associated with said inductive element based upon a change in the inductance thereof exceeding said threshold;

(c) monitoring the period and waveform of said oscillator signal to determine a magnitude of change in said period when the time rate of change significantly decreases and a proportionality value associated with a type vehicle entering the detection area;

(d) measuring a representative time rate of change of the period during an analysis period which is that time between the time at which the change in the oscillator signal exceeds said predetermined threshold and the time at which the magnitude change is determined;

(e) calculating an entry distance for a particular type of vehicle by multiplying a predetermined, average entry distance by said proportionality value;

(f) calculating an entry time by dividing the determined magnitude change in the period by the representative time rate of change of period; and (g) providing an output based on said magnitude change, representative time rate of change, entry distance, and entry time.

2. The method claim 1 wherein the output is representative of vehicle speed, and wherein providing the output comprises:

deriving an output representative of vehicle speed based upon the ratio of said calculated entry distance to said calculated entry time.

3. The method of claim 20, wherein the output is indicative of entry of a second vehicle into the detection area before a first vehicle has exited the detection area, and providing the output comprises:

setting a new vehicle detection threshold based on the previously determined magnitude of change; and detecting the second vehicle when a further change in inductance exceeds the new vehicle detection threshold.

4. The method of claim 1, wherein the output is representative of vehicle length, and wherein providing the output comprises:

detecting exit of the vehicle from the detection area based upon the value of the inductance monitored returning to substantially the same value as that monitored prior to vehicle entry;

determining a time period equivalent to a time duration between the first vehicle entry and the first vehicle exit; and deriving an output representative of the length of the first vehicle based upon the time rate of change of inductance, the magnitude of the change of inductance, the time period between first vehicle entry into and exit from the detection area, and the length of the detection area.

5. A method according to claim 1, wherein the representative time rate of change is determined by dividing said determined magnitude change by said analysis time.

6. A method according to claim 5, wherein the time rate of change is measured during each of a plurality of consecutive measurement periods occurring during the analysis time and the representative time rate of change is thereafter determined by taking the average of all time rate of change measurements made during the measurement periods.

7. A method according to claim 6, wherein said plurality of measurements occur over a plurality of equally spaced time increments.

8. A method of measuring speed of a vehicle with an inductive sensor driven by an oscillator to produce an oscillator signal having a period which is a function of inductance of the inductive sensor, the method comprising:

measuring the period of the oscillator signal during each of a plurality of consecutive measurement periods of known duration;

determining from changes in the measured oscillator signal period when the vehicle has entered a detection area associated with the inductive sensor;

determining a time rate of change of the oscillator signal period caused by the vehicle;

determining a magnitude change of a period caused by the vehicle;

deriving a vehicle entry time and entry distance based upon the time rate of change and the magnitude change of the period; and calculating a measured speed value based on the entry distance of a vehicle into said detection area and said vehicle entry time.

9. A method according to claim 8, further comprising:

deriving, from a plurality of measurements of the period after the vehicle has entered the detection area, an output which is a function of a change in period after the vehicle has entered the detection area.

10. The method of claim 9, further comprising:

determining a said representative time rate of change of the period based upon the plurality of measurements;

determining a said magnitude change of the period based upon the plurality of measurements; and deriving a said output representative of vehicle speed from the time rate of change and the magnitude change.

11. A vehicle sensing method comprising:

making a plurality of measurements of inductance of an inductive sensor;

producing a signal indicative of detection of a first vehicle when inductance has changed, as a result of the first vehicle entering a detection area associated with the inductive sensor, by greater than a first threshold;

determining, based upon the plurality of measurements, a magnitude of a change of inductance of the inductive sensor caused by the first vehicle;

determining a second threshold value based upon the magnitude of the change of inductance caused by the first vehicle;

producing a signal indicative of detection of a second vehicle entering the detection area before the first vehicle has left the detection area when inductance has changed by greater than the second threshold value; and resetting the second threshold value toward the first threshold value when the first vehicle exits the detection area.

12. A method of measuring vehicle length with an inductive sensor driven by an oscillator to produce an oscillator signal having a period which is a function of inductance of the inductive sensor, the method comprising:

setting an initial predetermined threshold beyond which a further change in said period is indicative of the presence of a said vehicle;

measuring the period of the oscillator signal during a plurality of frame segments;

determining, from a comparison between the period measured during at least one frame segment and said threshold, when a vehicle has entered a detection area associated with the inductive sensor;

determining a time rate of change of period caused by the vehicle;

determining a magnitude change of period caused by the vehicle;

detecting exit of the vehicle from the detection area based upon the value of the periods monitored, returning to substantially the same value as that monitoring prior to vehicle entry;

determining a time period comprised of the time duration between the vehicle entry and exit of the detection area; and deriving a measured vehicle length based upon the time period between entry and exit, the time rate of change of the oscillator signal period, the magnitude of the change of period, and the length of the detection area.

13. A vehicle speed detection system comprising:

an inductive sensor having an inductance which is affected by presence of a vehicle;

means for measuring the inductance of the inductive sensor during each of a plurality of consecutive measurement periods of known duration as the vehicle enters a detection area associated with the inductive sensor;

means for determining from changes in the measured inductance when a vehicle has entered said detection area;

means for deriving a time rate of change of the inductance of the inductive sensor as the vehicle entered the detection area;

means for deriving a vehicle entry time and entry distance based upon the time rate of change and the magnitude change; and means for producing an output signal representative of vehicle speed based on the entry distance and entry time.

14. A vehicle detection system according to claim 13, further comprising:

an inductive sensor;

means for making a plurality of measurements of inductance of the inductive sensor as each vehicle passes through a detection area associated with the inductive sensor;

means for detecting presence of a first vehicle based upon a change in inductance of the inductive sensor exceeding a first threshold;

means for determining, based upon the plurality of measurements, a magnitude of a change of inductance of the inductive sensor caused by the first vehicle;

means for determining a second threshold value based upon the magnitude of the change of inductance caused by the first vehicle;

means for producing a signal indicative of detection of a second vehicle entering the detection area before the first vehicle has left the detection area when inductance has changed by greater than the second threshold value; and means for resetting the second threshold value toward the first threshold value when the first vehicle exits the detection area.

15. The system of claim 14 and further comprising:

means for deriving a time rate of change of inductance of the inductive sensor as the vehicle entered the detection area; and means for producing an output signal representative of vehicle speed as a function of the time rate of change.

16. A method of detecting speed of a vehicle with a single inductive sensor having an inductance which changes upon the presence of a vehicle in a detection area, the method comprising:

setting an initial predetermined threshold beyond which a further change in said inductance is indicative of the presence of a said vehicle;

making a plurality of successive measurements of inductance of the inductive sensor;

deriving from a comparison of the plurality of measurements with said threshold the time at which a vehicle has first entered the detection area and a time required for the vehicle to move an entry distance into the detection area;

determining a magnitude inductance change caused by the vehicle; and providing an output signal representative of vehicle speed based upon the time required for the vehicle to move the entry distance and said magnitude inductance change.

17. The method of claim 15, wherein deriving the time required comprises:

deriving a time rate of change of the inductance as the vehicle entered the detection area;

deriving a magnitude of inductance change as the vehicle entered the detection area; and deriving from the time rate of change and the magnitude of inductance change, the time required for the vehicle to move the entry distance.

* * * * *